US006302384B1

(12) United States Patent
Douyama

(10) Patent No.: US 6,302,384 B1
(45) Date of Patent: Oct. 16, 2001

(54) NEEDLE VALVE CARBURETOR

(75) Inventor: Yoshiaki Douyama, Miyagi (JP)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/584,970

(22) Filed: Jun. 1, 2000

(51) Int. Cl.[7] ..... F02M 3/08

(52) U.S. Cl. ..... 261/71; 137/382; 261/DIG. 38; 261/DIG. 84

(58) Field of Search ..... 261/71, DIG. 38, 261/DIG. 84; 137/382

(56) References Cited

U.S. PATENT DOCUMENTS

| | | | | |
|---|---|---|---|---|
| 3,425,672 | * | 2/1969 | Seigel et al. | 261/DIG. 38 |
| 3,469,825 | * | 9/1969 | Du Bois | 261/71 |
| 4,271,093 | | 6/1981 | Kobayashi | 261/34.1 |
| 4,759,883 | * | 7/1988 | Woody et al. | 261/DIG. 84 |
| 5,133,905 | | 7/1992 | Woody et al. | 261/35 |
| 5,236,634 | | 8/1993 | Hammett et al. | 261/71 |
| 5,262,092 | | 11/1993 | Reeder et al. | 261/35 |
| 5,525,267 | * | 6/1996 | Araki | 261/DIG. 38 |
| 5,635,113 | * | 6/1997 | Walsh et al. | 261/DIG. 38 |
| 5,695,693 | * | 12/1997 | Koizumi et al. | 261/71 |
| 5,707,561 | * | 1/1998 | Swanson | 261/71 |
| 5,772,927 | * | 6/1998 | Koizumi et al. | 261/71 X |
| 5,776,379 | * | 7/1998 | Bowles | 261/DIG. 38 |
| 5,984,281 | | 11/1999 | Hacker et al. | 261/71 |
| 6,003,845 | | 12/1999 | Kus | 261/39.4 |

FOREIGN PATENT DOCUMENTS 9158783 6/1997 (JP) .

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor body including a cylindrical bore, a frusto-conical stepped shoulder portion, a valve chamber and an outlet passage which are coaxially provided and sequentially reduced in the inner diameter inwardly from an end wall face thereof. A plastic retainer and a metal collar are interference fitted into the cylindrical bore. The fuel regulating needle valve includes a screw shaft portion, an unthreaded stem portion and a valve tip which are sequentially reduced in the outer diameter from a head of the fuel regulating needle valve toward the valve tip. The threaded shaft portion is screwed into a threaded bore formed in the metal collar, and at the same time, screwed into an axial bore formed in the plastic retainer while cutting thread grooves. The unthreaded stem portion projects from a distal end cylindrical portion of the plastic retainer into the valve chamber, and the valve tip projects from the valve chamber into the outlet passage.

10 Claims, 2 Drawing Sheets

NEEDLE VALVE CARBURETOR

TECHNICAL FIELD OF THE INVENTION

The present invention relates to a carburetor with a regulating needle valve.

BACKGROUND OF THE INVENTION

In a conventional hydrocarbon liquid fuel carburetor for an internal combustion engine, a fuel regulating needle is used to control the flow of fuel or fuel and air mixture from the carburetor fuel chamber to the air intake passageway. A threaded shaft portion of a metal fuel regulating needle valve is screwed into a threaded bore formed in a metal carburetor body to project a valve tip of the needle valve from a valve chamber to an outlet passage. However, when the threaded bore is machined in the carburetor body, chips from machining in the threaded bore often remain therein and hinder a smooth screwing of the fuel regulating needle valve into the threaded bore.

In addition, due to the small size of the threads on the needle valve and in the bore of the carburetor body, it is difficult to achieve desired manufacturing tolerances. Any play in the tolerances may allow leakage between the two sets of threads. In addition, any play in the tolerance allows an undesirable axially shifting of the threaded valve needle which may change the fuel efficiency settings of the carburetor from its desired factory settings and allows undesirable evaporative emissions.

Furthermore, limiter caps mounted on the head of the fuel regulating needle valve may introduce certain complications. Limiter caps have recently been mandated in various jurisdictions to prevent the end user from easily adjusting the fuel needle valves excessively far from the manufacture's desired settings. These limiter cap; are commonly placed on the head of the fuel needle valve by a snap fit or press fit. As the caps are pressed onto the heads, axial force and radial force may displace the tip end needle from its desired position. Accordingly, accurate regulation may be hindered. The tip of the needle valve may be inclined and a lesser amount of fuel may flow from the valve chamber to the outlet passage as compared to a straight mounted tip of the needle valve. Furthermore, because of the diminutive dimension of the needle tip and the bore about the needle tip, a mere translational displacement of the needle tip from its radially central position may change the turbulence and other flow characteristics such that the flow rate may be undesirably changed from the desired setting.

Environmental efforts are also directed to minimize fuel evaporative emission which not only wastes fuel but may also have detrimental effects on air quality.

What is needed, in view of the above described problem, is a carburetor with a fuel regulating needle valve that is free from fuel leakage from the valve chamber to the exterior, or air leakage from the exterior to the valve chamber. Furthermore, what is needed is a fuel regulating needle that is firmly supported against vibrations and recovers from side and axial extended forces exerted thereon.

What is also needed is a carburetor with a fuel regulating needle that is screwed into a plastic retainer and a metal collar which are interference fitted in an unthreaded cylindrical bore in a carburetor body, thereby eliminating the need of machining the threaded bore within the carburetor body.

SUMMARY OF THE INVENTION

In accordance with the invention, a carburetor includes a carburetor body with an unthreaded cylindrical bore, a valve chamber and an outlet passage. Preferably, the cylindrical bore, valve chamber and outlet passage have a shoulder portion therebetween with the bore, valve chamber and outlet passage being axially aligned and sequentially reduced in diameter inwardly from an end wall of the carburetor to the outlet passage. A retainer and a separate collar are interference fitted into the unthreaded cylindrical bore. The fuel regulating needle valve includes a threaded shaft portion, an unthreaded stem and a valve tip. Preferably, the threaded shaft, unthreaded stem portion and valve tip are sequentially reduced in the outer diameter from a head of the fuel regulating needle valve toward a distal end of the valve tip. The threaded shaft portion is screwed into a threaded bore formed in the collar, and also screwed into an axial shaft receiving section formed in the retainer. The stem is slidably received through a distal end cylindrical portion of the retainer that has an aperture to slidably receive the unthreaded stem. The stem portion protrudes into the valve chamber, and the valve tip extends from the valve chamber into the outlet passage.

Preferably, the retainer is made from a plastic material and has an outer diameter slightly smaller than the diameter of the bore to allow the retainer to slide into the bore. The retainer has a counterbore at its outer end to receive the collar. The collar is made of metal and has an axial inner section having a diameter slightly larger than the internal diameter of the counterbore such that the collar is pressed fitted into the counterbore and expands the outer diameter of the retainer to sealingly press the retainer against the bore wall.

In one embodiment, the shaft receiving section of the retainer has a diameter substantially equal to the smaller diameter of the threaded shaft portion and is initially unthreaded to allow the threaded shaft portion to self tap its own threaded grooves into the shaft receiving section of the retainer. In another embodiment, the shoulder portion between the bore and valve chamber is frusto-conical in shape and the retainer has a complementary shaped frusto-conical section to sealingly abut thereagainst.

In the present invention, there is no need to machine a threaded bore directly in the carburetor body. Instead, a plastic retainer and the metal collar are inserted in the unthreaded cylindrical bore formed in the carburetor body. The threaded shaft portion of the fuel regulating needle valve is then screwed in an axial bore of the plastic retainer while forming thread grooves, and a tight screw fitting without axial play or leakage can be obtained. The base end cylindrical portion is enlarged to form a tight contact seal with the cylindrical bore of the carburetor. At the same time, an end wall of the plastic retainer is pressed against a conical stepped portion of the carburetor body to form a seal and the unthreaded stem portion form a sliding seal with respect to the distal end in the retainer.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
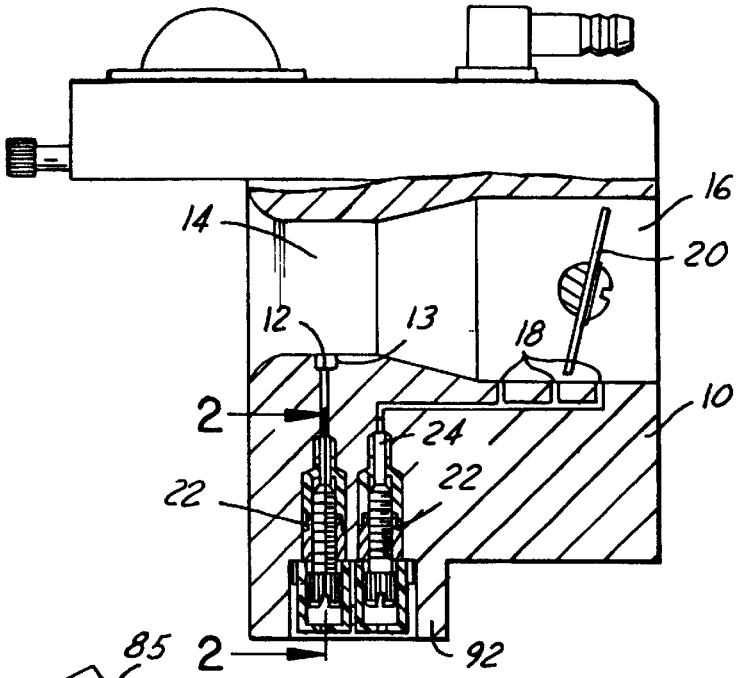
FIG. 1 is a sectional view of a carburetor incorporating the fuel regulating needle valve in accordance with the invention.
Figure 3:
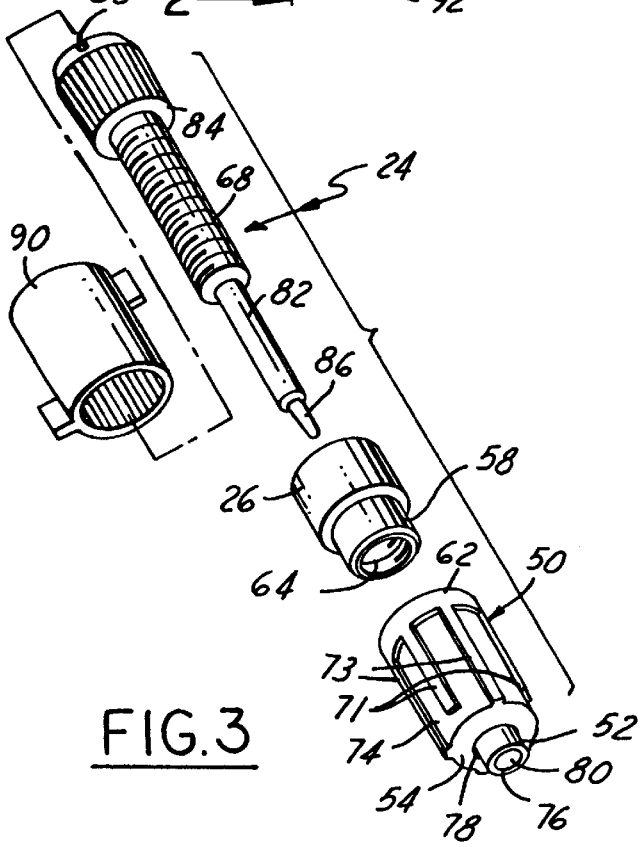
FIG. 3 is an exploded perspective view illustrating the retainer, collar, needle valve and limiter cap shown in FIG. 2.

Referring now to FIG. 1, a carburetor body 10 has a high speed fuel jet 12 and a check valve 13 in the venturi section 14 of intake passage 16. A plurality of low speed fuel jets 18 exit to the intake passage 16 in the vicinity of a closed (i.e. idle) position of throttle valve 20. The fuel is aspirated out of the jets 12 and 18 to the intake passage 16. The fuel is supplied from a constant pressure fuel chamber 17 as shown in FIG. 2 and the aspiration or flow rate is controlled by two needle valve assemblies 22 operably interposed between the constant pressure fuel chamber 17 and the respective jets 12 and 18.

Figure 2:
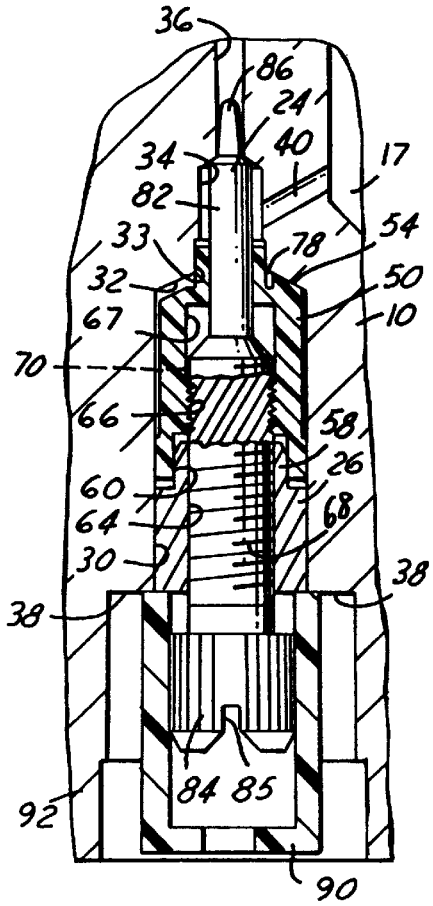
FIG. 2 is an enlarged sectional view taken along line 2—2 shown in FIG. 1.
Figure 4:
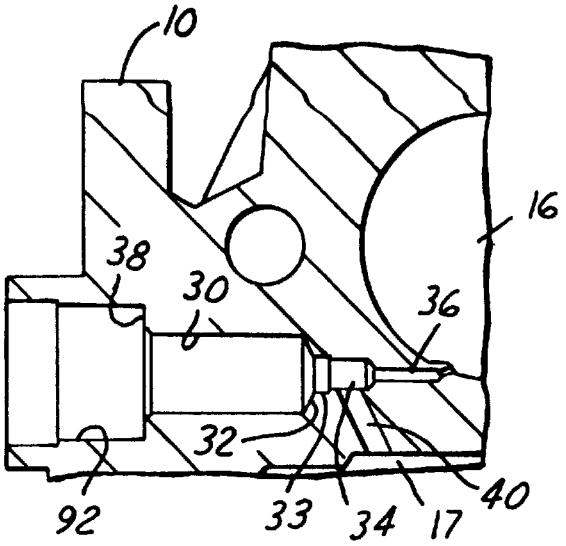
FIG. 4 is a fragmentary sectional view of the carburetor body shown in FIG. 1.

Referring now to FIG. 2, a fuel regulating needle valve 24 disposed in a carburetor body 10. The fuel regulating needle valve 24 is not supported or threaded directly into the carburetor body 10. Instead, the carburetor body 10 has an unthreaded bore 30 which receives intermediate collar 26 and plastic retainer 50 which in turn engage the needle valve 24. It should be understood that the bore 30 may also be incorporated in an intermediate wall member (not shown) which in turn is mounted onto the main carburetor body 10. For purposes of this patent, any intermediate wall member is considered a portion of the carburetor body 10. The carburetor body 10 coaxially includes a cylindrical bore 30, a frusto-conical shoulder portion 32, a valve chamber 34 and an outlet passage 36 which are sequentially reduced in diameter from an end wall face 38. The valve chamber 34 is in fluid communication with constant pressure fuel chamber 17 by way of an inlet passage 40. The outlet passage 36 is fluidly connected to either the low speed fuel jets 18 or the high speed fuel jet 12 shown in FIG. 1. Preferably, a cylindrical bore 33 is formed at a base end portion or the valve chamber 34. The cylindrical bore 33 has a diameter which is slightly larger than the diameter of the valve chamber 34.

The retainer 50 is formed from plastic material and is slidably inserted into the cylindrical bore 30 such that a distal end cylindrical portion 52 of the plastic retainer 50 is inserted into the small-diametered cylindrical bore 33 and its end wall 54 is pressed against the frusto-conical portion 32 of the bore 30.

A metal collar 26 is also interference fitted in the cylindrical bore 30 with its end portion 58 pressure fitted into a counterbore 60 at the base end 62 of the plastic retainer 50. The base end 62 of the plastic retainer is consequently enlarged by the press fit of the end portion 58 of the metal collar 26 to form a sealing fit with the cylindrical bore 30. The metal collar 26 is formed with an internal threaded bore 64.

The plastic retainer 50 is formed with an axial bore 66 to a midportion 70 thereof. The interior diameter of the axial bore 66 is sized to be smaller than an outside diameter of the threaded shaft portion 68 and larger than the diameter of a root portion of the thread to axial point 70. Thereafter, from point 70 and forwardly, the retainer 50 further protrudes into axial bore section 67. Section 67 optionally may have an inner diameter slightly larger than the outside diameter of the threaded shaft portion 68 of needle valve 24 such that the threads of the needle valve 24 do not engage the plastic of retainer 50 in section 67. Alternatively, the plastic retainer 50 has a plurality of axially extending narrow ribs 71 and 73 interposed by wide axial grooves 74 at its outer wall. The ribs 73 abutting against the frusto-conical portion 32, while ribs 71 are formed shorter to be spaced from the portion 32. Ribs 71 and 73 are alternately positioned equally spaced about the outer wall of retainer 50.

A distal end cylindrical portion 76 of the plastic retainer 50 projects from end wall 54 and is provided with an optional deep annular groove 78 at its base part. The distal end cylindrical portion 76 is constructed to be flexible to some extent with respect to the main body section of plastic retainer 50 for ease of entry into the small-diametered cylindrical bore 33. The cylindrical portion 76 has an aperture 80 sized to receive an unthreaded stem portion 82 of the needle valve 24.

The fuel regulating needle valve 24 comprises a head 84 provided with a tool receiving recess such as a slot 85, threaded shaft portion 68, an unthreaded stem portion 82, and a valve tip 86 which have sequentially reduced outer diameters. The threaded shaft portion 68 of the fuel regulating needle valve 24 is screwed into the threaded bore 64 of the metal collar 26, and then, into the axial bore 66 of the plastic retainer 50 while forming thread grooves therein. The unthreaded stem portion 82 is interference fitted into the distal end cylindrical portion 76 through aperture 80 and projected through the valve chamber 34 into the outlet passage 36. An amount of fuel flowing from the valve chamber 34 to the outlet passage 36 is regulated by the extent of projection of the valve tip 86 into the outlet passage 36 which in turn is controlled by screwing the needle valve 24 into position.

A plastic limiter cap 90 is then pressed fitted onto the head 84. Usually a pressure of 20–30 lbs of force is sufficient to press the cap 90 onto the head 84. The carburetor body 10 has a flange wall 92 that surrounds both limiter caps 90 of both valves 22 shown in FIG. 1. It should be noted that head 84 may be formed to accommodate any current limiter cap construction.

As described hereinabove, the threaded shaft portion 68 of the fuel regulating needle valve 24 usually formed of metal is not directly screwed into a threaded bore in the carburetor body but screwed into the threaded bore 64 of the metal collar 26 and then into the axial bore 66 of the plastic retainer 50 while forming the thread grooves therein. Therefore, vibrations causing the screw to move within the carburetor body 10 can be reduced, and a tight screw fitting between the axial bore 66 and the threaded shaft portion 68 can be obtained without an axial play or leakage. The plastic retainer 50 is tightly fitted in the cylindrical bore 30 of the carburetor body 10 with its base end cylindrical portion 62 enlarged by the end portion 58 of the metal collar 26 pressed therein, hence, no external air will be drawn into the valve chamber 34 through the cylindrical bores 30 and 33, or on the contrary, no fuel in the valve chamber 34 will leak through and out of the cylindrical bore 30. Moreover, since the unthreaded stem portion 82 is interference fitted into the distal end cylindrical portion 76, external air will not be drawn into the valve chamber 34 through the threaded bores 64 and 66, or on the contrary, no fuel in the valve chamber 34 will leak through and out from the threaded bores 64 and 66.

Optionally, the inner diameter of the axial bore 67 in the forward end part of the plastic retainer 50 is larger than the outer diameter of the threaded shaft portion 68 of the fuel regulating needle valve 24. As such, the threaded shaft portion 68 threadably engages only the axial bore 66 of the plastic retainer 50 while forming the thread grooves (thread forming or cutting) for a tight fit and for a constant torque of screwing the threaded shaft portion 68. The axial dimension or extent of the thread forming part into the portion 66 is always constant during normal adjustment of the needle valve 24, and as a result, a constant torque resistance is maintainable.

Furthermore, the stem portion 82 and hence valve tip 86 are centrally mounted such that valve tip 86 is coaxially mounted within outlet passage 36. Even when side torque forces may be momentarily exerted such as when cap 90 is pressed sideways while being pushed on head 84, the stem portion 82 and valve tip 86 return to the desired coaxial mounting better than prior art mounted valve stems and valve tips.

The formed thread also provides for better axial recovery during any momentary axial forces exerted on the needle valve 24 such as the axial forces exerted when cap 90 is pressed on for mounting purposes. As such, more accurate settings for fuel flow are possible and more consistent settings of the needle valve 24 are possible.

Furthermore, machining of a thread within a metal carburetor body is eliminated, thus simplifying the manufacturing process for the carburetor body 10. The large unthreaded bore 30 allows the use of cores and high speed machining which reduces costs and improves quality.

Figure 5:
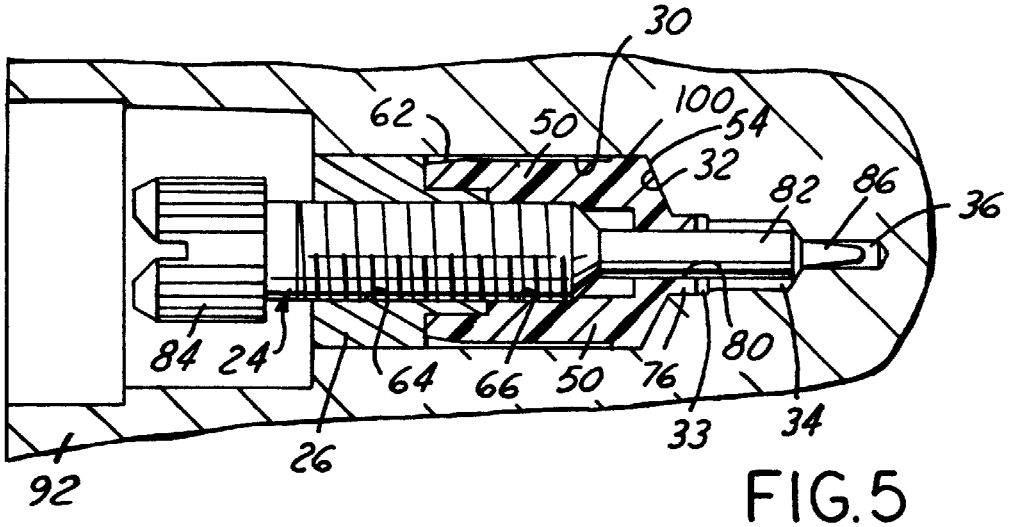
FIG. 5 is a view similar to FIG. 2 illustrating a second embodiment.

A second embodiment is illustrated in FIG. 5 where like parts will have the same reference numerals. In this embodiment, the plastic retainer 50 has an outer base section 100 that is enlarged to be interference fitted in bore 30. The forward conical end 54 is pressed against the conical section 32 to form a sealing fit. The groove 78 has been eliminated about end portion 76. The rear section 62 is tapered down to provide a gap with bore 30.

Figure 6:
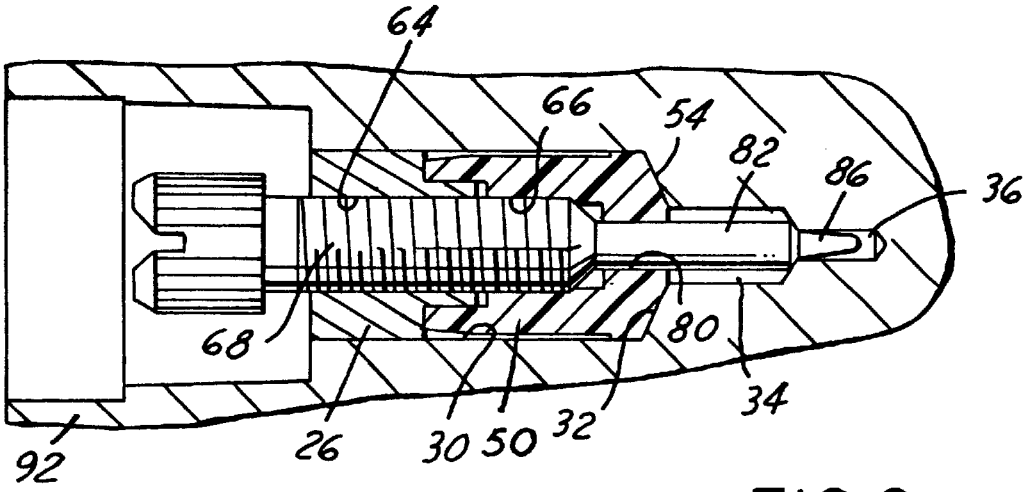
FIG. 6 is a view similar to FIG. 2 illustrating a third embodiment.

Reference now is made to FIG. 6 which discloses a third embodiment. This embodiment differs from the second embodiment in that the cylindrical end section 76 is eliminated from plastic retainer 50 and bore section 33 is eliminated from carburetor body 10. The stem portion 82 protrudes through aperture 80 within the confines of frustoconical wall section 54.

In all embodiments, the unthreaded stem portion 82 is interference fitted through an aperture 80 at the inner end of the plastic retainer. The fuel leakage from the valve chamber 34 to the threaded bore 64, 66 as well as the air leakage from the threaded bore 64, 66 to the valve chamber 34 can be reduced. Further, because the base end cylindrical portion of the resin retainer is tightly fitted to the cylindrical bore 30 in the carburetor body 10, the fuel leakage from the valve chamber to the cylindrical bore, or the air leakage from the cylindrical bore to the valve chamber can be reduced.

The fuel regulating needle valve is not directly supported by the carburetor body. The needle valve is supported by the threaded shaft portion 68 of the fuel regulating needle valve being screwed into the axial bore of the plastic retainer 50 and the unthreaded stem portion 82 is fitted through the distal end of the same plastic retainer 50. As such, the vibrations causing the screw to move within the carburetor can be reduced and a more precise positioning of the valve tip with respect to the outlet passage is possible that is more resistant to change from temporary axial and side loadings. The spaced apart support provided by the plastic retainer 50, namely, at the distal end of the retainer about the stem portion, and the threaded bore section 66 of the plastic retainer about the threaded section 64 along with the collar 26 along the needle valve 24 provides for superior support of the needle valve 24.

The fuel regulating needle valve will not be loosened with the vibration of the carburetor body because the threaded shaft portion of the fuel regulating needle valve is screwed into the axial bore in the plastic retainer while forming the thread grooves for a secure fit. Evaporative emissions due to undesirable leakage of fuel out of the carburetor body is also substantially reduced.

Chips generated by machining is eliminated and thus will not have a detrimental effect on the needle valve and regulation of the fuel amount due to the carburetor having an unthreaded bore.

Other variations and modifications are possible without departing from the spirit and scope of the invention as defined in the appended claims.

I claim:

1. A carburetor having a carburetor body including a cylindrical bore, a valve chamber and an outlet passage for housing a fuel regulating needle valve, said carburetor comprising:

a retainer and separate collar interference fitted into said cylindrical bore, said fuel regulating needle valve including a threaded shaft portion, an unthreaded stem portion and a valve tip, said threaded shaft portion being screwed into a threaded bore formed in said collar, and also screwed into a threaded shaft receiving section formed in said retainer, said unthreaded stem portion being slidably received through a distal end aperture of said retainer;

said unthreaded stem portion protruding into said valve chamber, and said valve tip extending from said valve chamber into said outlet passage.

2. A carburetor as defined in claim 1 further comprising:

said retainer being made from a plastic material, and having at its axially outer section, a counterbore having an outer diameter slightly smaller than the diameter of said cylindrical bore in said carburetor to allow said retainer to slide into said cylindrical bore, said collar being made of metal and having an axially inner section having a diameter slightly larger than the internal diameter of said retainer counterbore such that said collar is press fitted into said counterbore of said retainer and expands the retainer outer diameter to sealingly press against the cylindrical bore.

3. A carburetor as defined in claim 2 further comprising:

said shaft receiving section of said retainer having an inside diameter substantially equal to the smaller diameter of the threaded shaft portion of said fuel regulating needle valve and being initially unthreaded to allow said threaded shaft portion to form its own thread grooves into said shaft receiving section of said plastic retainer.

4. A carburetor as defined in claim 3 further comprising:

said carburetor having a stepped shoulder portion leading to the valve chamber which has a smaller diameter than said cylindrical bore and which in turn leads to the outlet passage which has a smaller diameter than said valve chamber, and said fuel regulating needle valve having said unthreaded stem portion with a diameter smaller than the threaded shaft portion and said valve tip having a reduced diameter from said unthreaded stem portion.

5. A carburetor as defined in claim 4 further comprising:

said stepped shoulder portion of said bore being frusto-conical in shape, and said retainer having a conical section complementarily shaped to sealingly abut against said stepped shoulder portion.

6. A carburetor as defined in claim 5, wherein at a base end of said valve chamber, there is provided a small-diametered cylindrical bore which is slightly larger in diameter than said valve chamber, and said distal end cylindrical portion of said retainer is inserted into said small-diametered cylindrical portion.

7. A carburetor as defined in claim 4 further comprising:

said shaft receiving section of said retainer having a diameter substantially equal to the smaller diameter of the threaded shaft portion and being initially unthreaded to allow said screw shaft portion to form its own thread grooves into said shaft receiving section of said plastic retainer.

8. A carburetor as defined in claim 7 further comprising:

said stepped shoulder portion of said bore being frusto-conical in shape, and said retainer having a frusto-conical section complementarily shaped to sealingly abut against said stepped shoulder portion.

9. A support structure for a fuel regulating needle valve in a carburetor as defined in claim 6, wherein at a base end of said valve chamber, there is provided a small-diametered cylindrical bore which is slightly larger in diameter than said valve chamber, and said distal end portion of said plastic retainer is inserted into said small-diametered cylindrical portion.

10. A carburetor as defined in claim 1, wherein at a base end of said valve chamber, there is provided a small-diametered cylindrical bore which is slightly larger in diameter than said valve chamber, and said distal end portion of said retainer is inserted into said small-diametered cylindrical portion.

* * * * *